US006539795B1

(12) United States Patent
Scherpenisse et al.

(10) Patent No.: US 6,539,795 B1
(45) Date of Patent: Apr. 1, 2003

(54) METHOD FOR DETERMINING A FLUID CONTACT LEVEL IN A HYDROCARBON FLUID BEARING FORMATION

(75) Inventors: Willem Scherpenisse; Johannes Nicolaas Maria Van Wunnik, both of Rijswijk (NL)

(73) Assignee: Shell Oil Company, Houston, TX (US)

( * ) Notice: Subject to any disclaimer, the term of this patent is extended or adjusted under 35 U.S.C. 154(b) by 57 days.

(21) Appl. No.: 09/630,130

(22) Filed: Aug. 1, 2000

(30) Foreign Application Priority Data

Feb. 8, 1999 (EP) ..... 99202541

(51) Int. Cl.[7] ..... G01F 23/00
(52) U.S. Cl. ..... 73/290 R; 73/299; 340/626
(58) Field of Search ..... 73/299, 64.54, 73/152.18, 152.51; 340/614

(56) References Cited

U.S. PATENT DOCUMENTS 4,282,750 A 8/1981 Prats et al.
4,366,714 A * 1/1983 Adorni ..... 73/708
4,531,087 A * 7/1985 Larson ..... 324/696
4,694,692 A * 9/1987 Brown et al. ..... 73/152.22
4,868,491 A * 9/1989 Black ..... 324/694
4,903,207 A 2/1990 Alger
4,984,447 A * 1/1991 Phillips ..... 73/38
5,621,169 A 4/1997 Harris et al.
5,758,538 A * 6/1998 Hubbell et al. ..... 73/73
5,826,458 A * 10/1998 Little ..... 73/73
6,076,396 A * 6/2000 Dadachanji et al. ..... 73/73

* cited by examiner

*Primary Examiner*—Hezron Williams
*Assistant Examiner*—André K. Jackson

(57) ABSTRACT

A method for determining the depth ($D_L$) of a fluid contact level between a first fluid (F1), such as water, and a second fluid (F2), such as crude oil or natural gas, within the pores of an oil and/or gas bearing formation surrounding a borehole comprises measuring the phase pressure $P_{F1}$ and $P_{F2}$ of said pore fluids using a pressure probe assembly which is lowered to a depth ($D_P$) above the depth of said contact level ($D_L$) and determining the depth of said interface on the basis of the equation:

Figure 1:
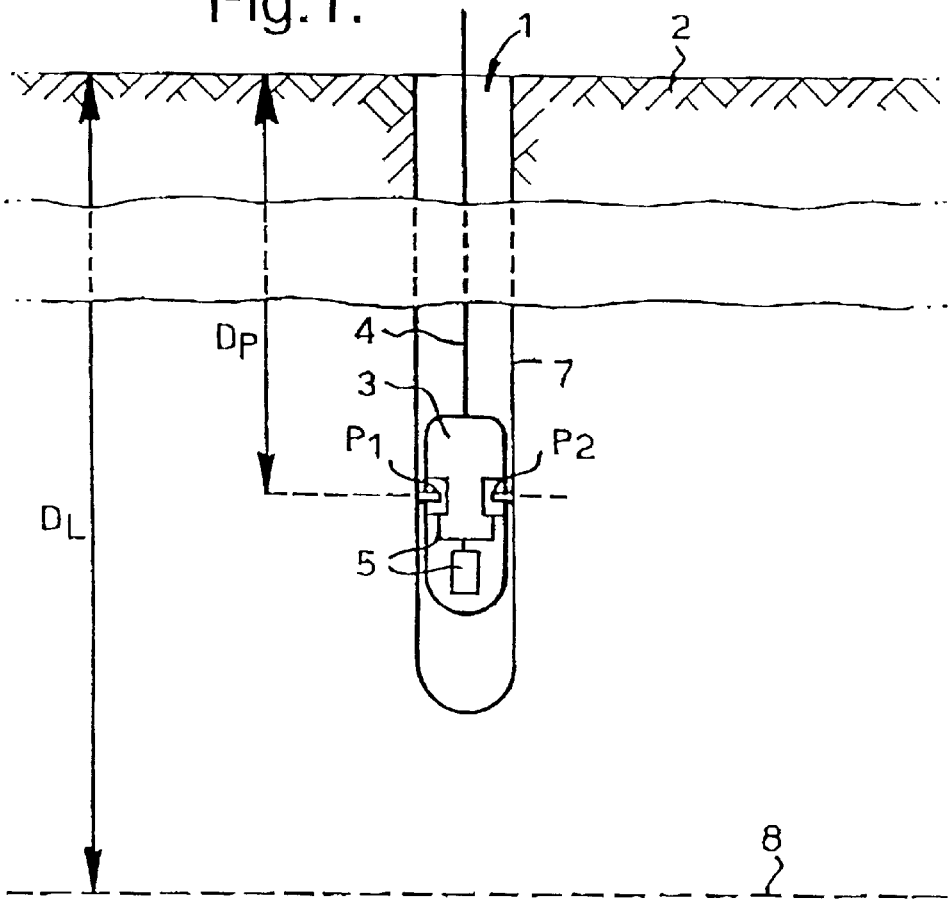

$$D_P - D_L = \frac{P_{F1} - P_{F2}}{g(\rho_{F1} - \rho_{F2})}$$

15 Claims, 1 Drawing Sheet

METHOD FOR DETERMINING A FLUID CONTACT LEVEL IN A HYDROCARBON FLUID BEARING FORMATION

BACKGROUND OF THE INVENTION

The invention relates to a method for determining a fluid contact level in a hydrocarbon fluid bearing formation which surrounds and/or underlays an underground borehole.

In many situations one or more exploration wells are drilled into an oil and/or gas bearing formation such that the well does not reach the oil-water, the oil-gas and/or the gas-water interface in that formation.

It is known from U.S. Pat. No. 5,621,169 to predict the hydrocarbon/water contact level for oil and gas wells on the basis of measured data from well log and core analysis information and on basis of a worldwide correlation of permeability and porosity to a function of capillary pressure, without making actual capillary pressure measurements.

European patent application 586001 discloses a method for generating by way of experimental tests with core samples, the capillary pressure curve in a porous medium.

U.S. Pat. No. 4,903,207 discloses a method for determining reservoir bulk volume of hydrocarbons from reservoir porosity and distance to oil-water contact level which distance is determined from log data and capillary pressure analysis of core data.

U.S. Pat. No. 4,282,750 discloses a tool which measures in-situ the partial water pressure in an oil bearing reservoir whilst the partial oil pressure is measured using previously known formation sampling techniques which involve taking a core sample and determining the partial pressure and density of the crude oil present in the pores.

A disadvantage of the known methods is that they require complex and time consuming core sample analysis and correlation techniques.

The present invention aims to provide a method of determining the fluid contact level in hydrocarbon fluid bearing formation in a more simple, accurate and direct manner, without require time consuming core sampling and core sample analysis procedures.

SUMMARY OF THE INVENTION

In accordance with the invention there is provided a method for determining the depth ($D_L$) of a fluid contact between a first fluid (F1) having a fluid density ($\rho_{F1}$) and a second fluid (F2) having another fluid density ($\rho_{F2}$), which fluids are present in the pores of an hydrocarbon fluid bearing formation surrounding or underlaying an underground borehole, the method comprising:

lowering a pressure probe assembly to a depth ($D_P$) into the borehole and pressing a pair of pressure probes against the borehole wall, one of said pressure probes being adapted to measure solely the phase pressure ($P_{F1}$) of the first fluid (F1) in the pores of the formation surrounding the borehole, the other pressure probe being adapted to measure solely the phase pressure ($P_{F2}$) of the second fluid (F2) in the pores of the formation surrounding the borehole; and determining the depth of said fluid interface ($D_L$) on the basis of the following equation:

$$D_P - D_L = \frac{P_{F1} - P_{F2}}{g(\rho_{F1} - \rho_{F2})}$$

where g is the gravitational acceleration.

Suitably, the first fluid is water and the second fluid is a hydrocarbon fluid, such as crude oil or natural gas, and the method is used to determine the free water level in a hydrocarbon fluid bearing formation where said free water level is located in or below the bottom of the borehole.

Alternatively, the first fluid is crude oil and the second fluid is natural gas.

In case the densities of the first and second fluid are not known, or not accurately known, it is preferred that the probe assembly is initially lowered to a first depth (I) and subsequently to a second depth (II) in the well and the pressure probes are actuated to take pore pressure measurements at each of said depths and the measurements are used to determine and/or verify the fluid densities $\rho_{F1}$ and $\rho_{F2}$ of the first and second fluids, according to the well-known formula:

$$\rho_F = \frac{P_2 - P_1}{g(D_2 - D_1)}$$

where $P_2$ is the pressure for the fluid measured at depth $D_2$, $P_1$ is the pressure for the fluid measured at depth $D_1$ and g is the gravitational acceleration constant.

It is generally preferred that the measurements are made using a probe assembly which comprises a first pressure probe comprising a first pressure transducer which is mounted in a measuring chamber of which one side is permeable to the first fluid and impermeable to the second fluid, which side is pressed against the borehole wall during a predetermined period of time while the pressure transducer is actuated; and a second pressure probe comprising a second pressure transducer which is mounted in a measuring chamber of which one side is permeable to the second fluid and impermeable to the first fluid, which side is pressed against the borehole wall during a predetermined period of time while the second pressure transducer is actuated.

DESCRIPTION OF A PREFERRED EMBODIMENT

Figure 2:
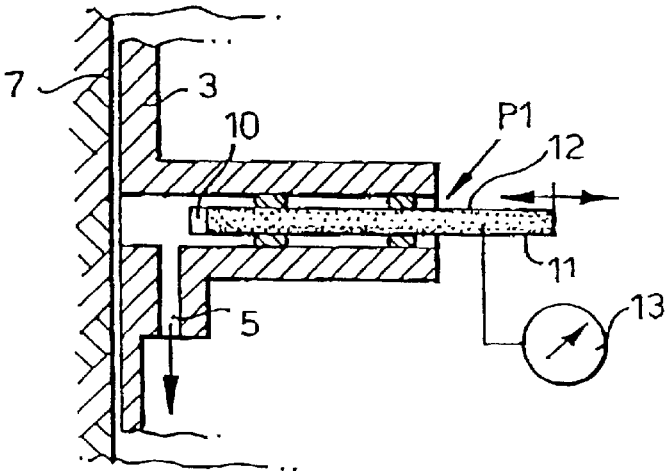

The invention will be described in more detail with reference to the accompanying drawings, in which FIG. 1 is a schematic longitudinal sectional view of a well in which a probe assembly according to the invention is present; and FIG. 2 is a more detailed sectional view of one of the pressure probes of the probe assembly of FIG. 1.

Referring to FIG. 1 there is shown a borehole 1 which traverses an underground rock formation 2.

A probe assembly 3 for measuring the depth $D_L$ of an oil-water contact level 8 in the pores of the formation 2 has been lowered into the borehole 1 on a wireline 4. The probe assembly 3 comprises a first pressure probe P1 for measuring the partial pressure of any oil in the pores of the rock formation 2 surrounding the borehole 1 and a second pressure probe P2 for measuring the partial pressure of any water in the pores of the rock formation 2 surrounding the borehole 1.

The probe assembly 3 furthermore comprises a pump and fluid container 5.

The depth of the two probes P1 and P2 is at $D_P$ and of the oil-water fluid contact level 8 is at $D_L$. With the probes P1 and P2 the pressure in the reservoir can be measured for the selected fluids: oil and water. With the pump 5 reservoir fluids can be pumped into the container, in this way drilling fluid contaminations can be removed from the borehole wall 7. The detail of the pressure probes P1 and P2 are shown in FIG. 2. A water wet filter 10 (a selective water permeable ceramic membrane) or oil wet filter (a selective oil permeable Teflon membrane) is mounted on a hollow piston 11 that can be pressed against the borehole wall. The fluid 12 in the piston 11 is miscible with the reservoir fluid to be measured, i.e. oil in the piston with the oil wet filter and water in the piston with the water wet filter 10. The phase pressures $P_{F1}$ and $P_{F2}$ are measured by a pressure gauge 13 in each probe. After cleaning the borehole surface 7 from contaminations by pumping reservoir fluids the pump 5 is stopped and the pistons with the filters are pressed against the borehole surface 7 and the pressures recorded. From the measured partial oil and water pressures $P_{F1}$ and $P_{F2}$ fluid pressures, the densities of the fluids and $D_P$, the value of $D_L$ can be calculated from the equation:

$$D_P - D_L = \frac{P_{F1} - P_{F2}}{g(\rho_{F1} - \rho_{F2})}$$

The probes are tested to work satisfactory in laboratory experiments where an oil pressure measuring probe and a water pressure measuring probe were pressed at opposite sides against the side wall of a cylindrical core sample from an oil bearing rock formation. During the experiments oil was flushed away by pumping water in longitudinal direction through the core sample so that an oil-water contact level was created and oil was gradually replaced by water in the pores of the sample. The partial oil and water pressures measured by the pressure probes according to the invention appeared to correlate well with the independently calculated partial oil and water pressures in pores of the sample during this experiment.

The foregoing embodiments of the inventions and their methods of application are non-limiting and have been given for the purpose of illustrating the invention. It will be understood that modifications can made as to its structure, application and use and still be within the scope of the claimed invention. Accordingly, the following claims are to be construed broadly and in a manner consistent with the spit and scope of the invention.

What is claimed is:

1. A method for determining the depth ($D_L$) of a fluid contact level between a first fluid (F1) having a fluid density ($\rho_{F1}$) and a second fluid having another fluid density ($\rho_{F2}$), which fluids are present in the pores of an hydrocarbon fluid bearing formation surrounding or underlying an underground borehole, the method comprising:

(a) lowering a pressure probe assembly to a depth ($D_P$) into the borehole and pressing a pair of pressure probes against the borehole wall, one of said pressure probes being adapted to measure solely the phase pressure ($P_{F1}$) of the first fluid (F1) in the pores of the formation surrounding the borehole, the other pressure probe being adapted to measure solely the phase pressure ($P_{F2}$) of the second fluid (F2) in the pores of the formation surrounding the borehole; and (b) determining the depth of said fluid contact level (DL) on the basis of the equation:

$$D_P - D_L = \frac{P_{F1} - P_{F2}}{g(\rho_{F1} - \rho_{F2})}$$

where g is the gravitational acceleration.

2. The method of claim 1, wherein the first fluid is water and the second fluid is a hydrocarbon fluid and the method is used to determine the free water level in a hydrocarbon fluid bearing formation where said free water level is located below the bottom of the borehole.

3. The method of claim 1, wherein the first fluid is crude oil and the second fluid is natural gas.

4. The method of claim 1, wherein the probe assembly is initially lowered to a first depth (I) and subsequently to a second depth (II) in the well and the pressure probes are actuated to take pore pressure measurements at each of said depths and the measurements are used to determine and/or verify the fluid densities $\rho_{F1}$ and $\rho_{F2}$ of the first and second fluids.

5. A probe assembly for use in the method according to claim 1, which probe assembly comprises (a) a first pressure probe comprising a first pressure transducer which is mounted in a measuring chamber of which one side is permeable to the first fluid and impermeable to the second fluid, which side is pressed against the borehole wall during a predetermined period of time while the pressure transducer is actuated; and (b) a second pressure probe comprising a second pressure transducer which is mounted in a measuring chamber of which one side is permeable to the second fluid and impermeable to the first fluid, which side is pressed against the borehole wall during a predetermined period of time while the second pressure transducer is actuated.

6. The probe assembly of claim 5, comprising an elongate probe carrier body to which the first and second fluid transducer are movably secured at diametrically opposite locations such that the transducers can simultaneously be expanded against and retracted from the borehole wall.

7. The probe assembly of claim 5, wherein probe assembly is designed to measure the oil-water contact level and the first pressure probe has a measuring chamber which is filled with water and has a side made of a selective water permeable ceramic membrane which is in use pressed against the borehole wall and the second pressure probe has an oil-filled measuring chamber and a side made of a selective oil permeable membrane which is in use pressed against the borehole wall.

8. A method for determining the depth of an interface between two fluids in an earth formation ($D_L$), the first fluid having a density $\rho_{F1}$ and the second fluid having a density $\rho_{F2}$, the steps comprising:

(a) positioning a tool in a borehole traversing the earth formation at a known depth ($D_P$), said tool having at least one pressure measurement probe, including a pressure transducer, capable of selectively measuring the formation phase pressure attributable to the first fluid or the second fluid, (b) positioning said pressure probe so as to be in fluid communications with the earth formation;

(c) measuring said phase pressure attributable to the first fluid ($P_{F1}$);

(d) measuring said phase pressure attributable to the second fluid ($P_{F2}$);

(e) determining the depth of the interface according to the formula:

$$D_P - D_L = \frac{P_{F1} - P_{F2}}{g(\rho_{F1} - \rho_{F2})}$$

where g is the gravitational acceleration constant.

9. The method of claim 8, wherein said pressure measurement probe further includes a first measurement probe and a second measurement probe, each measurement probe including a pressure transducer.

10. The method of claim 9, wherein a first element permeable solely to the first fluid is disposed between the earth formation and said first pressure measurement probe transducer and a second element permeable solely to the second fluid is disposed between the earth formation and said second pressure measurement probe transducer.

11. The method of claim 8, wherein the first fluid is water and the second fluid is a liquid hydrocarbon.

12. The method of claim 8, wherein the first fluid is water and the second fluid is a gaseous hydrocarbon.

13. The method of claim 8, wherein the first fluid is a gaseous hydrocarbon and the second fluid is a liquid hydrocarbon.

14. The method of claim 8, further including the step of cleaning the earth formation opposite the pressure probe prior to step.

15. The method of claim 9, further including the step of cleaning the earth formation opposite said first and second measurement probes prior to steps (c) and (d).

* * * * *